US011187181B2

(12) United States Patent
Dembinski et al.

(10) Patent No.: US 11,187,181 B2
(45) Date of Patent: Nov. 30, 2021

(54) COMBUSTION ENGINE HOUSING HAVING CYLINDER COOLING

(71) Applicant: Bayerische Motoren Werke Aktiengesellschaft, Munich (DE)

(72) Inventors: Norbert Dembinski, Munich (DE); Roy Dille, Munich (DE); Attila Solymosi, Munich (DE); Thomas Spiess, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/824,099

(22) Filed: Mar. 19, 2020

(65) Prior Publication Data

US 2020/0217268 A1 Jul. 9, 2020

Related U.S. Application Data

(63) Continuation of application No. PCT/EP2018/072189, filed on Aug. 16, 2018.

(30) Foreign Application Priority Data

Sep. 20, 2017 (DE) ..... 10 2017 216 694.0

(51) Int. Cl.
*F02F 1/14* (2006.01)
*F01P 3/02* (2006.01)

(52) U.S. Cl.
CPC ..... *F02F 1/14* (2013.01)

(58) Field of Classification Search
CPC ..... F01P 3/02; F01P 2003/021; F01P 7/14; F02F 1/40; F02F 1/14; F02F 2001/106
See application file for complete search history.

(56) References Cited

U.S. PATENT DOCUMENTS 4,686,943 A 8/1987 Anno et al.
5,115,771 A * 5/1992 Ozawa ..... F02F 1/004 123/41.72

(Continued)

FOREIGN PATENT DOCUMENTS

CN 1308183 A 8/2001
CN 102072040 A 5/2011

(Continued)

OTHER PUBLICATIONS

International Search Report (PCT/ISA/210) issued in PCT Application No. PCT/EP2018/072189 dated Nov. 28, 2018 with English translation (seven pages).

(Continued)

*Primary Examiner* — Long T Tran
(74) *Attorney, Agent, or Firm* — Crowell & Moring LLP

(57) ABSTRACT

A combustion engine housing with cylinder cooling includes at least one cylinder. The cylinder cooling channel has a distribution cross-sectional area having a cross-sectional area through which coolant can flow, in a first cross-sectional plane that is perpendicular to the cylinder axis. In a second cross-sectional plane, which is perpendicular to the cylinder axis and which is arranged in relation to the vertical direction between the first cross-sectional plane and the coolant outflow opening, has a throttle cross-sectional area, which is a cross-sectional area through which coolant can flow. The throttle cross-sectional area is smaller than the distribution cross-sectional area.

12 Claims, 3 Drawing Sheets

(56) References Cited

U.S. PATENT DOCUMENTS

| | | | | |
|---|---|---|---|---|
| 5,233,947 | A | 8/1993 | Abe et al. | |
| 2005/0235931 | A1 | 10/2005 | Zahdeh | |
| 2006/0016573 | A1 | 1/2006 | Kenitz | |
| 2011/0132295 | A1 | 6/2011 | Hamakawa et al. | |
| 2016/0195036 | A1* | 7/2016 | Mori | F02F 1/14 123/41.79 |
| 2017/0067411 | A1* | 3/2017 | Doho | F01P 3/02 |
| 2017/0159601 | A1* | 6/2017 | Park | F02F 1/14 |

FOREIGN PATENT DOCUMENTS

| | | | |
|---|---|---|---|
| DE | 689 07 485 | T2 | 10/1993 |
| DE | 10 2005 018 364 | A1 | 12/2005 |
| DE | 10 2010 055 723 | A1 | 6/2012 |
| DE | 10 2015 003 335 | A1 | 9/2016 |
| EP | 1 116 871 | A2 | 7/2001 |
| GB | 234232 | A | 5/1925 |
| JP | 56-157347 | U | 11/1981 |
| JP | 60-153843 | U | 10/1985 |
| JP | 61-138861 | A | 6/1986 |
| JP | 6-74090 | A | 3/1994 |

OTHER PUBLICATIONS

German-language Written Opinion (PCT/ISA/237) issued in PCT Application No. PCT/EP2018/072189 dated Nov. 28, 2018 (five pages).

German-language Office Action issued in German Application No. 10 2017 216 694.0 dated May 17, 2018 (three pages).

Chinese-language Office Action issued in Chinese Application No. 201880053953.0 dated Apr. 2, 2021 with English translation (18 pages).

* cited by examiner 10
6a
11
7
8
6b
3
A-A 2b
8
6b
12
A
A
2a
6a 1
2b
7
4b
3
4a
2a 1
7
10
3
3I
4a
2a
6a
3II
2b
6b
5a
2h II
3
4a
I
6a
2a
2h
3db
5a
3dh
3d
3v
3vb

COMBUSTION ENGINE HOUSING HAVING CYLINDER COOLING

CROSS REFERENCE TO RELATED APPLICATIONS

This application is a continuation of PCT International Application No. PCT/EP2018/072189, filed Aug. 16, 2018, which claims priority under 35 U.S.C. § 119 from German Patent Application No. 10 2017 216 694.0, filed Sep. 20, 2017, the entire disclosures of which are herein expressly incorporated by reference.

BACKGROUND AND SUMMARY OF THE INVENTION

The invention relates to a combustion engine housing with cylinder cooling according to the generic term of the first claim. A cylinder crankcase with a cast cooling channel is known from DE 10 2010 055 723 A1.

The embodiments of the invention are described below using the example of a combustion engine with a combustion engine housing with multiple circular cylinders arranged side by side or in series, wherein this is not to be understood as a limitation of the invention to such an embodiment.

In such a combustion engine, i.e. with a so-called in-line engine or V engine, heat is generated in the cylinders that is dissipated partly via the combustion engine housing and a cylinder cooling channel arranged therein. The direction of the coolant, which flows through the cylinder cooling channel and absorbs waste heat from the cylinder, is influenced by the design of the cylinder cooling channel, whereby it is a goal to achieve a uniform temperature distribution in the wall surrounding the cylinder.

Against this background, DE 10 2010 055 723 A1 proposes to arrange a cooling channel in the cylinder web for a cylinder crankcase of a combustion engine.

One of the objects of the embodiments of the invention is to specify a combustion engine housing with improved cooling. This and other objects are achieved by a combustion engine housing disclosed herein.

For the purposes of the invention, a combustion engine is to be understood as a thermal engine with internal combustion in a reciprocating piston construction, in particular a so-called gasoline or diesel engine. In such a combustion engine, a fuel-air mixture is burned in one or more combustion chambers in a cylinder. The combustion sets a piston that is accommodated in the cylinder in motion, thereby resulting a reciprocating movement of the piston along a straight cylinder axis. This movement is transferred to a so-called crankshaft, which is thereby moved in a rotational motion. Such combustion engines are known from the prior art.

Such a combustion engine comprises a combustion engine housing with at least one such cylinder. This combustion engine housing is understood as a so-called crankcase or cylinder crankcase. At least one cylinder is arranged in this combustion engine housing. This cylinder is set up as explained for accommodation of the piston, which moves along the cylinder axis in the vertical direction between a lower dead center and an upper dead center.

The cylinder axis is to be understood as an imaginary axis of symmetry of the cylinder. Furthermore, in this sense the cylinder is to be understood as a preferably circular aperture in this combustion engine housing. The cylinder axis extends in the vertical direction as a straight line into this combustion engine housing. The cylinder is surrounded by the combustion engine housing in the circumferential direction, i.e. around this cylinder axis, wherein this thereby forms a wall around the cylinder. In the combustion engine housing, a cylinder cooling channel is provided for cooling the cylinder.

A cylinder cooling channel is to be understood as an aperture in the combustion engine housing that is set up to carry a flow of a coolant in such a way that heat transfer takes place from the cylinder into the coolant during the normal operation of the combustion engine. The coolant is a liquid medium, preferably a water-based medium. Combustion engines with so-called water cooling in the combustion engine housing are sufficiently known from the prior art.

The cylinder cooling channel surrounds the cylinder in the circumferential direction at least partially or preferably completely. Especially with a cylinder partially surrounded by the cylinder cooling channel, a particularly simple construction of the combustion engine housing results. Especially with a cylinder completely surrounded by the cylindrical cooling channel, a particularly good heat transfer from the cylinder into the cylinder cooling channel results.

Furthermore, the cylinder cooling channel comprises a coolant inflow opening and a coolant outflow opening. Referring to the flow through the cylinder cooling channel during normal operation of the combustion engine, the coolant flows through the cylinder channel from the coolant inflow opening to the coolant outflow opening. The coolant inflow opening is to be understood as an aperture in the combustion engine housing that is fluidically connected to the cylinder cooling channel and that is set up for supplying the coolant to the cylinder cooling channel. For the purposes of the invention, the coolant outflow opening is to be understood as an aperture in the combustion engine housing that is fluidically connected to the cylinder cooling channel and that is set up for dissipating the coolant from the cylinder cooling channel.

Referring to the vertical direction (the vertical extent of the cylinder along the cylinder axis), the coolant inflow opening is arranged spaced apart from the coolant outflow opening in the combustion engine housing. In this sense, the coolant inflow opening is arranged in a lower area of the cylinder and the coolant outflow opening is preferably arranged in an upper area. Preferably, the coolant outflow opening is arranged at least partially or completely above the coolant inflow opening. In particular, the term below and above can be viewed in relation to lower dead center (bottom) and upper dead center (above).

In the vertical direction between the coolant inflow opening and the coolant outflow opening, a so-called cooling channel throttle area is arranged. This cooling channel throttle area is set up to increase the flow resistance of the coolant on the flow path from the coolant inflow opening to the coolant outflow opening. This "increase" refers to a cylinder cooling channel design without such a cooling channel throttle area and is in particular to be understood as a reduction of the cross-section that can be flowed through by the coolant, in particular in relation to an area of the cylinder cooling channel below this throttle area.

The cooling channel throttle area is understood as a narrowing or an area of a cross-section of the cylinder cooling channel that can be flowed through by coolant, wherein this area is arranged between the coolant inflow opening and the coolant outflow opening such that the coolant must flow through this narrowed area on the way from the coolant inflow opening to the coolant outflow opening.

A first/second cross-sectional plane is to be understood as an imaginary plane that is oriented orthogonally to the cylinder axis. In relation to the arrangement in the vertical direction, the first cross-sectional plane is arranged at the level of the coolant inflow opening, the first cross-sectional plane preferably intersects the coolant inflow opening and the cross-sectional plane is preferably tangential to the coolant inflow opening. In relation to the vertical direction the second cross-sectional plane is arranged above the first cross-sectional plane. Furthermore, the second cross-sectional plane is arranged between the first cross-sectional plane and the coolant outflow opening in the vertical direction and the second cross-sectional plane is preferably tangential to the coolant outflow opening.

A distribution cross-sectional area of the cylinder cooling channel is to be understood as a cross-sectional area of the cylinder cooling channel that lies in the first cross-sectional plane and that can carry or does carry a flow of coolant during normal operation of the combustion engine, i.e. when coolant is flowing from the coolant inflow opening to the coolant outflow opening. The cylinder cooling channel preferably comprises this distribution cross-sectional area, or a cooling channel width dimension of the distribution cross-sectional area, in a distribution area of the cylinder cooling channel (cooling channel distribution area), at least in sections.

A throttle cross-sectional area is to be understood as a cross-sectional area of the cylinder cooling channel that lies in the second cross-sectional plane and that carries a flow of coolant during normal operation of the combustion engine, i.e. when coolant is flowing from the coolant inflow opening to the coolant outflow opening. The second cross-sectional area lies downstream to the first cross-sectional area in relation to a coolant flow from the coolant inflow opening to the coolant outflow opening.

In particular, homogenization of the coolant flow through the cylinder cooling channel can be achieved by an embodiment of the cylinder cooling channel in which the throttle cross-sectional area is smaller than the distribution cross-sectional area, and thus improved cylinder cooling can be achieved.

Figuratively speaking, with cylinder cooling channels known from the prior art, uneven, so-called diagonal flow of the coolant through the cylinder cooling channel can occur. In this case, such a known cylinder cooling channel may have the coolant inflow opening at the bottom right and the coolant outflow opening at the top left in a cylinder longitudinal section through the cylinder (the cylinder axis is part of this sectional plane and is perpendicular for the following explanation). And furthermore, the area above the coolant inflow opening and on the opposite side from the coolant outflow opening, thus figuratively speaking at the top right, is cooled less than an area at the bottom left. Such a phenomenon can be reduced or prevented by means of the invention, since homogenization of the coolant flow can be achieved with the invention.

The cooling channel throttle area may be provided between the coolant inflow opening and the coolant outflow opening in the vertical direction. The throttle cross-sectional area, which is arranged in the second cross-sectional plane, lies in this cooling channel throttle area. The cylinder cooling channel has a cooling channel width dimension in this cooling channel throttle area, at least in sections or in the entire cooling channel throttle area, which is smaller than the coolant channel width dimension in the distribution cross-sectional area. In particular, the cooling channel width dimension in the throttle cross-sectional area is smaller than a smallest cooling channel width dimension or an average cooling channel width dimension in the distribution cross-section area. In particular, homogenization of the cooling effect in relation to the cylinder occurs due to such an embodiment of the cylinder cooling channel and improved cylinder cooling can thus be achieved.

The combustion engine housing may comprise at least 2 or more cylinders spaced apart from each other in a longitudinal direction. In particular, an in-line engine, or in the case of a number of cylinders also a so-called V engine, can be represented by such a combustion engine housing. In particular, an imaginary longitudinal sectional plane is spanned by this longitudinal direction and a cylinder axis of one of these cylinders.

The coolant inflow opening is preferably arranged on a first side of this longitudinal sectional plane in the combustion engine housing. Furthermore, the coolant outflow opening is arranged on a second side of this longitudinal sectional plane in the combustion engine housing, so that the coolant inflow opening and the coolant outflow opening are arranged on different sides of this longitudinal sectional plane. In particular, a so-called cross-scavenged combustion engine housing results from such an arrangement of the coolant inflow opening and the coolant outflow opening. Investigations have shown that particularly efficient cylinder cooling can be achieved by means of a cross-scavenged combustion engine housing.

A combustion engine housing with multiple cylinders may be provided, wherein the number of cylinders is greater than the number of coolant inflow openings and the number of coolant outflow openings. There is preferably at least one coolant inflow opening arranged on a first cylinder of a row of cylinders and one coolant outflow opening arranged on a last cylinder of the row of cylinders, so that a coolant flow can form in the longitudinal direction starting from the coolant inflow opening to the coolant outflow opening and this therefore results in a uniflow-scavenged combustion engine housing (in relation to the coolant flow during normal operation of the combustion engine).

In a certain area of the cylinder, in relation to the circumferential direction or over the entire circumference of the cylinder, the cooling channel width dimension may decrease in the coolant channel throttle area in the vertical direction from the coolant inflow opening to the coolant outflow opening. Preferably, this decrease in the cooling channel width dimension is continuous and further preferably the decrease of the cooling channel width dimension in the vertical direction is in a straight line. In particular, a particularly uniform distribution of the coolant flow can be achieved by a decrease in the cooling channel width dimension in the vertical direction of the cylinder. Preferably, the cooling channel throttle area extends over at least 10% of the cooling channel height dimension, preferably over at least 20% of the cooling channel height dimension, further preferably over at least 30% of the cooling channel height dimension and particularly preferably over at least 50% of the cooling channel height dimension. Investigations have shown that with such an extended cooling channel throttle area, particularly good homogenization of the coolant flow can be achieved.

The combustion engine housing may comprise multiple coolant inflow openings and multiple coolant outflow openings. In particular, a higher and more uniform coolant throughput through the combustion engine housing and thus better cylinder cooling can be achieved with a larger number of coolant inflow openings and coolant outflow openings.

The number of coolant inflow openings may correspond to the number of cylinders of the combustion engine housing or the number of cylinders arranged next to each other in a row. Further preferably, the number of coolant outflow openings corresponds to the number of cylinders of the combustion engine housing or the number of cylinders arranged next to each other in a row. In particular, particularly good cylinder cooling can be achieved by means of such a numerical configuration with respect to the coolant inflow openings and coolant outflow openings.

The combustion engine housing may be limited in the vertical direction at an upper side by a cylinder head supporting surface, at least in the area of the cylinder or a number of cylinders. This cylinder head supporting surface is designed in particular for the support of a so-called cylinder head gasket or a cylinder head. Preferably, the cylinder cooling channel extends fully into this cylinder head supporting surface, wherein figuratively speaking, in such a case the cylinder head supporting surface is interrupted by the cylinder cooling channel. In particular, simple production, especially casting manufacturing, of the cylinder cooling channel can be achieved by means of such an embodiment of the combustion engine housing.

The combustion engine housing, may be limited in the vertical direction at an upper side by a cylinder head supporting surface, at least in the area of the cylinder or in the area of a number of cylinders. And in this embodiment the cylinder cooling channel does not extend to this cylinder head supporting surface, at least in sections. In particular in an area in which the cylinder cooling channel does not extend to the cylinder head supporting surface, this is bounded in the vertical direction by an upper web, wherein this upper web extends into the cylinder head supporting surface and is bounded thereby. In particular, a potential supporting surface for a cylinder head gasket is enlarged by this upper web.

Preferably, such an upper web is arranged in the area between two cylinders that are arranged adjacent to each other, and such an upper web is preferably arranged in the area of a so-called cylinder web, i.e. in particular in the area of a minimum wall thickness of the combustion engine housing between two adjacent cylinders. In particular, the potential supporting area for a cylinder head gasket can be increased by one or more upper webs, and a better sealing effect for a cylinder head to be mounted on the combustion engine housing can thus be achieved.

The cylinder cooling channel may have an inner cooling channel sheath surface and an outer cooling channel sheath surface. The cylinder cooling channel is bounded in the circumferential direction, at least in sections, by these two cooling channel sheath surfaces, wherein the inner cooling channel sheath surface is arranged radially inside and the outer cooling channel sheath surface is arranged radially outside relative to the cylinder axis. Further preferably, these two sheath surfaces are each arranged concentrically to the cylinder axis. In particular, the embodiment with these two sheath surfaces results in a cylinder cooling channel that narrows from the coolant inflow opening in the vertical direction to the coolant outflow opening, having its largest cooling channel width dimension in the area of the coolant inflow opening. In particular, due to such an embodiment of the cylinder cooling channel, the cylinder cooling channel has a lower flow resistance in the area of the coolant inflow opening than in the area in which the cylinder cooling channel has already narrowed (cooling channel throttle area). In particular, this design of the cylinder cooling channel provides a homogenized flow of the coolant (homogenization) and improved cylinder cooling can thus be achieved.

Furthermore, a combustion engine with a combustion engine housing of the previously described construction type is provided. This combustion engine is preferably embodied as a so-called in-line engine or V engine. Further preferably, the combustion engine comprises a so-called cylinder head, which is connected to the combustion engine housing and limits the cylinder or cylinders upwards in the vertical direction. Furthermore, at least one piston is provided in the combustion engine that during normal operation moves reciprocally along the cylinder axis in the cylinder between the upper and lower dead points.

Drive power can be transferred from this piston to a crankshaft, which is fully or partially accommodated in this combustion engine housing. In this sense, the combustion engine can be understood in particular as a single-cylinder, in-line or V engine, which can be operated according to the diesel or gasoline principle and the cylinder cooling channel of which has the previously described form.

Other objects, advantages and novel features of the present invention will become apparent from the following detailed description of one or more preferred embodiments when considered in conjunction with the accompanying drawings, in which:

DETAILED DESCRIPTION OF THE DRAWINGS

Figures 1A, 1B, 1C, 1D, 1E:
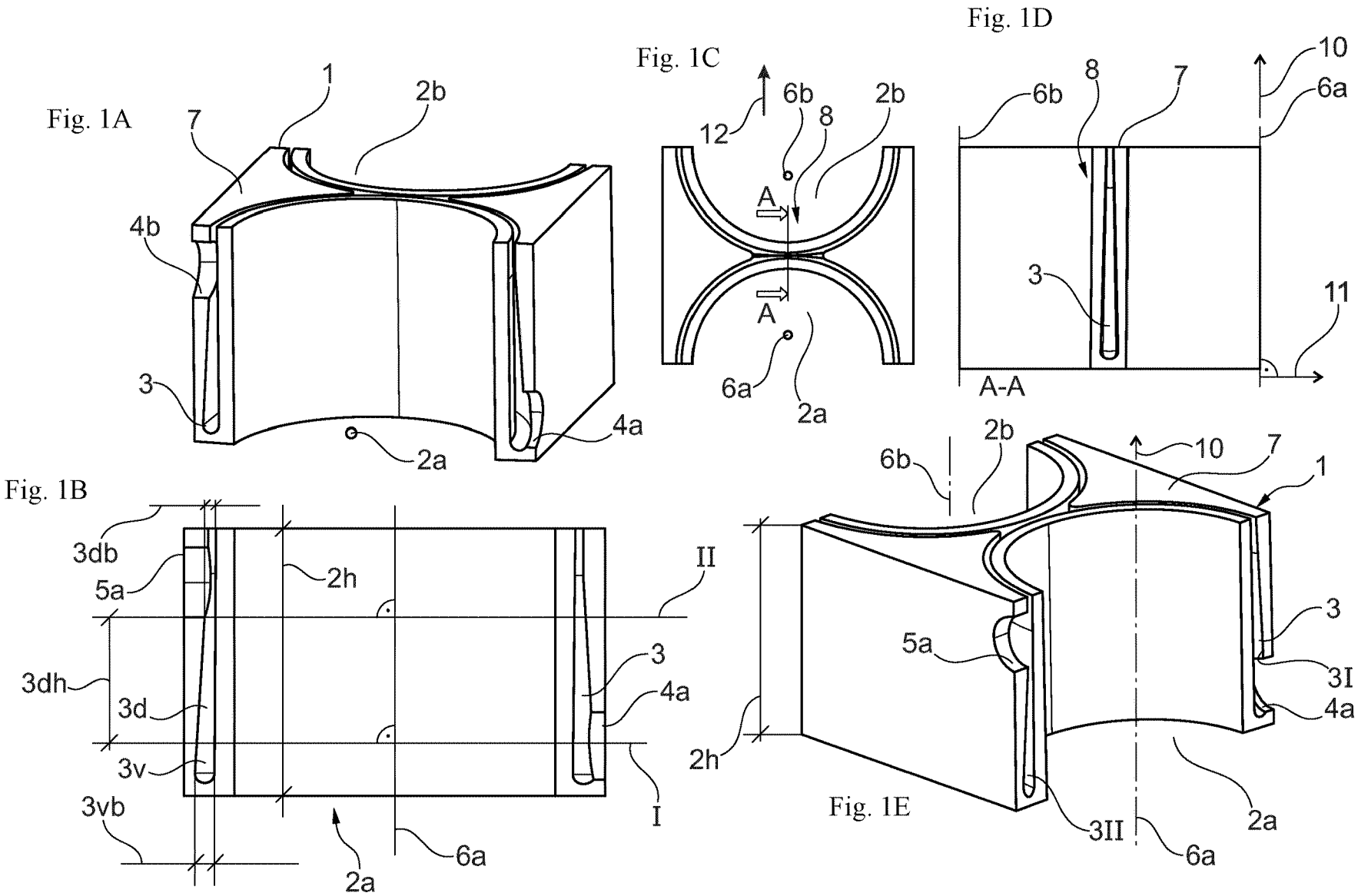
FIGS. 1A to 1E show different subsections of a first variant of the combustion engine housing with a cylinder cooling channel.

In FIG. 1 *a*) a perspective partial sectional representation of 2 cylinders arranged in a combustion engine housing (2*a*, 2*b*) is shown. A cylinder cooling channel 3 for cylinder cooling is arranged in the combustion engine housing 1. The cylinder cooling channel 3 is set up to be flowed through by a coolant during normal operation of a combustion engine with such a combustion engine housing 1. This coolant absorbs and dissipates heat generated by the combustion of fuel in the cylinder. The cylinder cooling channel 3 comprises a coolant inflow opening 4*a* and a coolant outflow opening 5*a*. The coolant flows through the cylinder cooling channel 3 from the coolant inflow opening 4*a* to the coolant outflow opening 5*a* during normal operation of the combustion engine.

In FIG. 2 *b*) a partial section view of the combustion engine housing 1 is shown. In this view, the first cross-sectional plane I and the second cross-sectional plane II can be recognized. The two cross-sectional planes I, II are each oriented orthogonally to the cylinder axis 6*a* of the cylinder 2*a*. The first cross-sectional plane I is arranged in the area of the coolant inflow opening 4*a* and in this plane I the cylinder cooling channel 3 has the cooling channel width dimension 3*vb*. This cooling channel width dimension 3*vb* is larger than the cooling channel width dimension 3*db* in the second cross-sectional plane II, which is arranged between the first cross-sectional plane I and the coolant outflow opening 5*a* and thus in the cooling channel throttle area 3*d*.

It can be seen that the cylinder cooling channel 3 in the cooling channel throttle area 3*d* has a continuously decreasing cooling channel width dimension. The cooling channel throttle area 3*d* extends in the vertical direction over the distance 3*dh*, which corresponds to about 50% of the height dimension 2*h* of the cylinder 2*a*. Due to this embodiment of the cylinder cooling channel 3, it is achieved that a uniform coolant flow can form from the coolant inflow opening 4*a* to the cooling outflow opening 5*a*. In the cooling channel distribution area 3*v*, the flow resistance for the coolant is lower than in the coolant channel throttle area 3*d*, in particular favoring homogenization of the coolant flow.

FIG. 1 *c*) shows a plan view of the section of the combustion engine housing 1 that is shown in FIG. 1 *a*). In the view shown, a part of the first cylinder 2*a* and of the second cylinder 2*b* can be recognized, wherein these are arranged adjacent to each other in the longitudinal direction 12. Each of the cylinders 2*a*, 2*b* has a cylinder axis 6*a*, 6*b*. In this FIG. 1 *c*) the section line A-A can be recognized, wherein the view corresponding to this section line is shown in FIG. 1 *d*). The section A-A runs through the cylinder web 8, i.e. through the wall of the combustion engine housing between the first cylinder 2*a* and the second cylinder 2*b*.

In FIG. 1 *d*) a further partial sectional view of the combustion engine housing 1 is shown. Through the section A-A shown, the shape of the cylinder cooling channel 3 can be recognized in the so-called cylinder web 8. The vertical direction 10 appears in the direction of the first cylinder axis 6*a* and orthogonal to this is the width direction 11. It can further be recognized that the cylinder cooling channel 3 extends into the cylinder head supporting surface 7. The cylinder head supporting surface 7 is thus interrupted in the area of the cylindrical web 8 by the cylinder cooling channel 3.

In FIG. 1 *e*) a further perspective partial sectional representation of a section of the combustion engine housing 1 is shown. In this sectional representation a part of the first cylinder 2*a* and a part of the second cylinder 2*b* can be recognized, wherein each of these extends along the first cylinder axis 6*a* and along the second cylinder axis 6*b* respectively. The cylinder cooling channel 3 is bounded radially to the first cylinder axis 6 by the outer cooling channel sheath surface 3 I and the inner cooling channel sheath surface 3 II.

Here, the outer cooling channel sheath surface 3 I is partially conical (cooling channel throttle area) and the inner cooling channel sheath surface 3 II is cylindrical, so that narrowing of the cross-section of the cylinder cooling channel 3 in the vertical direction 10 from the coolant inflow opening 4*a* to the coolant outflow opening 5*a* results. Both the first cylinder 2*a* and the second cylinder 2*b* have a height dimension 2*h*. In particular, a particularly uniform distribution of the coolant when flowing through the cylinder cooling channel 3 results from this embodiment of the cylinder cooling channel 3 with the cylinder cooling channel narrowing in the vertical direction.

FIG. 2 shows a further embodiment of the invention, wherein the differences from the embodiment of the invention shown in FIG. 1 will substantially be discussed below.

Figure 2D:
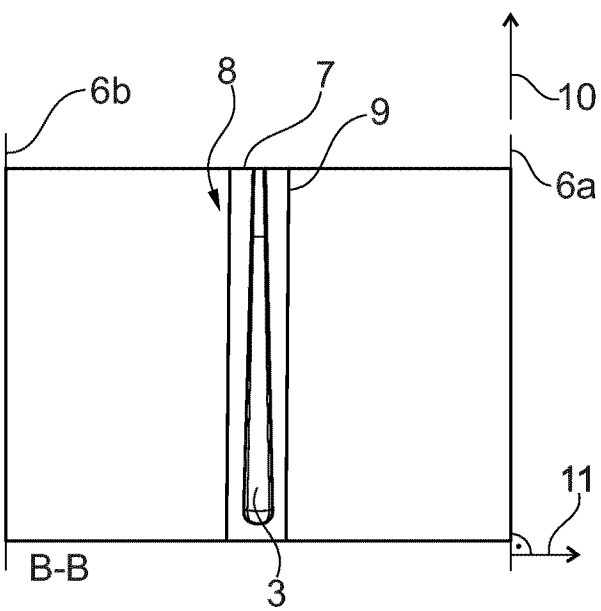
FIGS. 2A to 2D show different subsections of a first variant of the combustion engine housing with a cylinder cooling channel.
Figure 2C:
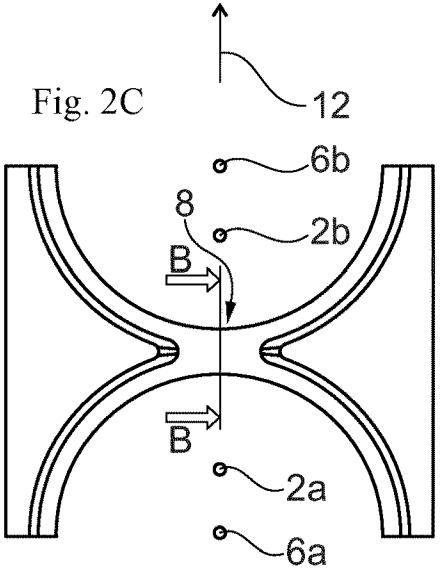
Figure 2A:
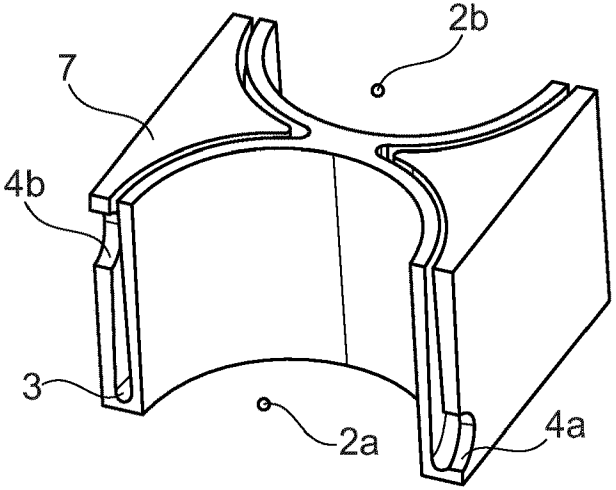
Figure 2B:
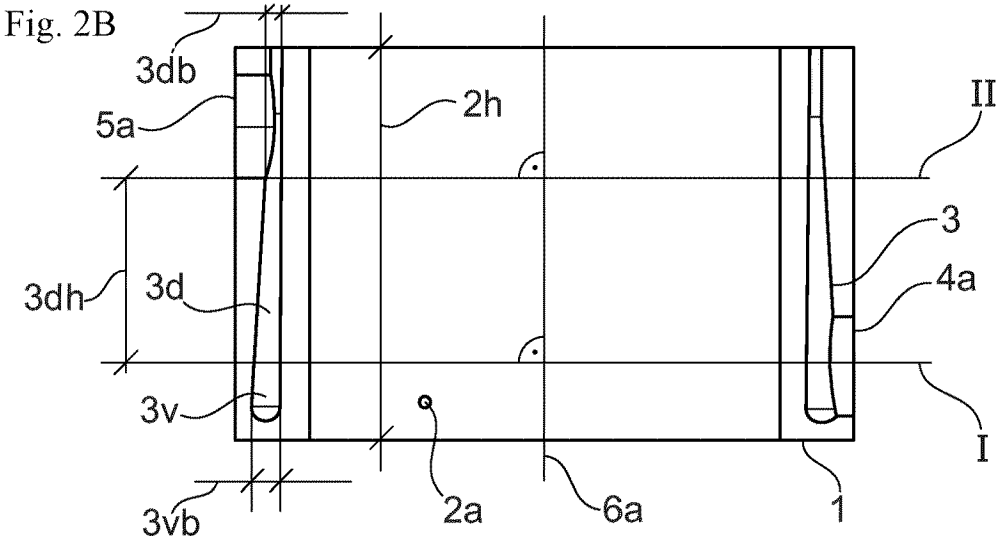

In FIG. 2*c*) the section line B-B is drawn in the cylinder web 8, wherein the partial sectional view of the combustion engine housing resulting from this section line B-B is shown in FIG. 2 *d*).

In FIG. 2 *d*) it can be recognized that the cylinder cooling channel 3 is delimited relative to the cylinder head supporting surface 7 by the upper web 9. Thus, unlike in the embodiment of the invention illustrated in FIG. 1, the cylinder cooling channel 3 does not extend in this area (cylinder web) into the cylinder head supporting surface 7, but ends before this and is thus bounded by the upper web 9, and the cylinder head surface 7 is thus enlarged compared to the variant of the invention represented in FIG. 1.

The partial sectional view shown in FIG. 2 *b*) corresponds to the view shown in FIG. 1 *b*), since in this section there are no differences between the two different embodiments of the invention shown.

Figure 3:
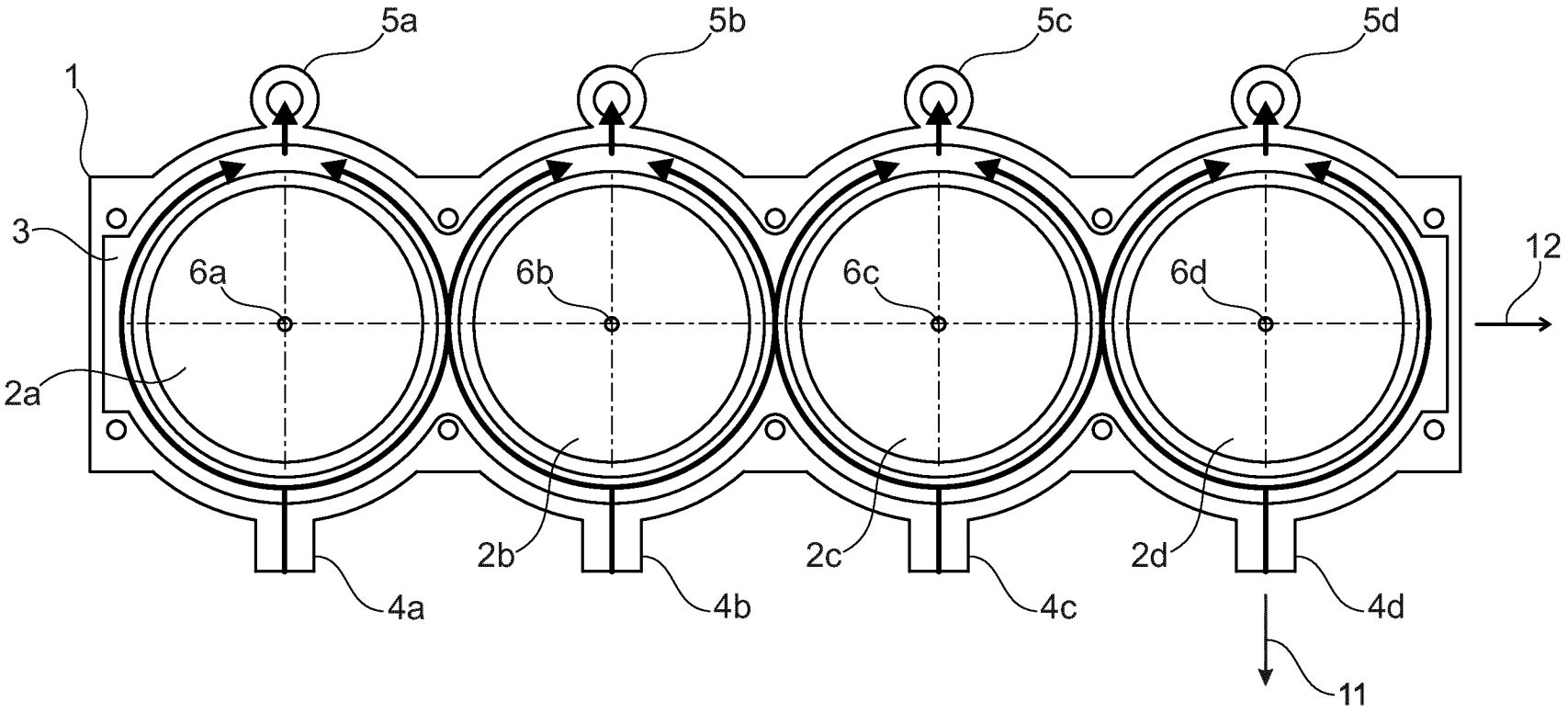
FIG. 3 shows a cross-sectional representation of a cross-scavenged combustion engine housing with a cylinder cooling channel.

In FIG. 3, a plan view of four cylinders 2*a*, 2*b*, 2*c*, 2*d* arranged in a row is shown, as is the case with an 8 cylinder V engine with four cylinders in a cylinder bank or in a 4-cylinder in-line engine. The 4 cylinders 2*a*, 2*b*, 2*c*, 2*d* are arranged adjacent to each other in the longitudinal direction 12 and each has a cylinder axis 6*a*, 6*b*, 6*c*, 6*d*, along each of which a piston (not shown) moves reciprocally during normal operation of the combustion engine, and by this movement sets a crankshaft (not shown) in rotation.

The cylinder cooling channel 3 comprises a number of coolant inflow openings 4*a*, 4*b*, 4*c*, 4*d* and a number of coolant outflow openings 5*a*, 5*b*, 5*c*, 5*d*. By means of the arrow representations, the coolant flow from the coolant inflow openings 4*a*, 4*b*, 4*c*, 4*d* to the coolant outflow openings 5*a*, 5*b*, 5*c*, 5*d* is shown as it is set up during normal operation of the combustion engine. The number of coolant inflow openings 4*a*, 4*b*, 4*c*, 4*d* and the number of coolant outflow openings 5*a*, 5*b*, 5*c*, 5*d* corresponds to the number of cylinders 2*a*, 2*b*, 2*c*, 2*d*. This embodiment of the combustion engine housing results in a cross-scavenged combustion engine housing.

REFERENCE CHARACTER LIST

1 Combustion engine housing
2*a*,2*b*, 2*c*,2*d* Cylinders of the combustion engine housing
2*h* Cylinder height dimension
3 Cylinder cooling channel
3*d* Throttle area of the cylinder cooling channel
3*v* Distribution area of the cylinder cooling channel
3*db* Cooling channel width dimension of the cylinder cooling channel in the cooling channel throttle area
3*dh* Height dimension of the cooling channel throttle area
3*vb* Cooling channel width dimension in the cylinder cooling channel distribution area
3 I Outer cylinder cooling channel area
3 II Inner cylinder cooling channel sheath surface
4*a*,4*b*, 4*c*,4*d* Coolant inflow opening
5*a*,5*b*, 5*c*,5*d* Coolant outflow opening
6*a*,6*b*, 6*c*,6*d* Cylinder axes of the cylinders
7 Cylinder head supporting surface
8 Cylinder web
9 Upper web
10 Vertical direction
11 Width direction
12 Longitudinal direction
I First cross-sectional plane
II Second cross-sectional plane The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A combustion engine housing with cylinder cooling comprising:

at least one cylinder, wherein the at least one cylinder is set up to accommodate a working piston moving in the vertical direction along a cylinder axis between a lower dead point and an upper dead point, wherein the at least one cylinder is surrounded in the circumferential direction by the combustion engine housing and a cylinder cooling channel is provided for cylinder cooling in the combustion engine housing, wherein this cylinder cooling channel partially or completely surrounds the at least one cylinder in the circumferential direction, wherein the cylinder cooling channel has a cooling channel height extent in the direction of the cylinder axis and orthogonal thereto a cooling channel width extent and further the cylinder cooling channel comprises a coolant inflow opening and a coolant outflow opening, wherein the coolant inflow openings and the coolant outflow openings are coupled directly to a cylinder wall and are spaced apart in the vertical direction from the coolant outflow openings, wherein the cylinder cooling channel has a distribution cross-sectional area, having a cross-sectional area through which coolant can flow, in a first cross-sectional plane that is perpendicular to the cylinder axis, in a second cross-sectional plane, which is perpendicular to the cylinder axis and which is arranged in relation to the vertical direction between the first cross-sectional plane and the coolant outflow opening, has a throttle cross-sectional area, which is a cross-sectional area through which coolant can flow, and the throttle cross-sectional area is smaller than the distribution cross-sectional area.

2. The combustion engine housing according to claim 1, wherein a cooling channel throttle area is provided between the coolant inflow opening and the coolant outflow opening in the vertical direction, the throttle cross-sectional area is arranged in this cooling channel throttle area, and in the cooling channel throttle area the cooling channel width dimension is smaller than a cooling channel width dimension in the distribution cross-section area.

3. The combustion engine housing according to claim 2, wherein the combustion engine housing comprises two cylinders spaced apart from each other in a longitudinal direction, an imaginary longitudinal plane is spanned by this longitudinal direction and the cylinder axis of one of the cylinders, and the coolant inflow opening and the coolant outflow opening are arranged on different sides of this longitudinal sectional plane, so that a cross-scavenged combustion engine housing results in relation to a coolant flow through the cylinder cooling channel.

4. The combustion engine housing according to claim 3, wherein in a specific area in relation to the circumferential direction or over the entire circumference of the cylinder, the cooling channel width dimension in the cooling channel throttle area decreases continuously in the vertical direction from the coolant inflow opening to the coolant outflow opening, and the cooling channel throttle area extends over at least 10% of the height dimension of the cylinder.

5. The combustion engine housing according to claim 4, wherein multiple coolant inflow openings and multiple coolant outflow openings are provided.

6. The combustion engine housing according to claim 5, wherein the number of coolant inflow openings corresponds to the number of cylinders of the combustion engine housing.

7. The combustion engine housing according to claim 6, wherein the number of coolant outflow openings corresponds to the number of cylinders of the combustion engine housing.

8. The combustion engine housing according to claim 7, wherein the combustion engine housing is bounded in the vertical direction at an upper side by a cylinder head supporting surface, and the cylinder cooling channel extends fully up to this cylinder head supporting surface.

9. The combustion engine housing according to claim 7, wherein the combustion engine housing is bounded in the vertical direction at an upper side by a cylinder head supporting surface, and the cylinder cooling channel does not extend to this cylinder head supporting surface, at least in sections, so that in these sections the cylinder cooling channel is bounded in relation to the cylinder head supporting surface by an upper web that extends to the cylinder head supporting surface.

10. The combustion engine housing according to claim 9, wherein multiple cylinders are provided adjacent to each other in a longitudinal direction, and the upper web is arranged in a section between two adjacent cylinders in relation to the circumferential direction around one of these cylinders.

11. The combustion engine housing according to claim 10, wherein an outer sheath surface of the cylinder cooling channel has a conical shape, an inner sheath surface of the cylinder cooling channel has a cylindrical shape, and as a result of the cylindrical shape the cylinder cooling channel has a narrowing shape in the vertical direction from the coolant inflow opening to the coolant outflow opening.

12. A combustion engine with internal combustion in the form of a reciprocating piston design and with multiple cylinders in which combustion chambers are formed, with a combustion engine housing according to claim 11.

* * * * *